US007751753B2

(12) United States Patent
Sakagawa et al.

(10) Patent No.: US 7,751,753 B2
(45) Date of Patent: Jul. 6, 2010

(54) CLEANERLESS IMAGE FORMING APPARATUS

(75) Inventors: Yoshio Sakagawa, Hyogo (JP); Tetsumaru Fujita, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 246 days.

(21) Appl. No.: 11/954,309

(22) Filed: Dec. 12, 2007

(65) Prior Publication Data

US 2008/0145100 A1 Jun. 19, 2008

(30) Foreign Application Priority Data

Dec. 15, 2006 (JP) ..... 2006-338508

(51) Int. Cl.
*G03G 15/30* (2006.01)
*G03G 15/00* (2006.01)

(52) U.S. Cl. ..... 399/149; 399/159

(58) Field of Classification Search ..... 399/148, 399/149, 150, 159
See application file for complete search history.

(56) References Cited

U.S. PATENT DOCUMENTS 6,215,971 B1 * 4/2001 Sakoh et al. ..... 399/159
6,459,872 B1 * 10/2002 Komiya et al. ..... 399/149
6,730,448 B2 * 5/2004 Yoshino et al. ..... 399/159 X
7,177,581 B2 * 2/2007 Kawada et al. ..... 399/159 X
2002/0081130 A1 * 6/2002 Endo et al. ..... 399/349
2007/0065179 A1 3/2007 Fujita
2007/0172259 A1 7/2007 Fujita
2007/0280735 A1 12/2007 Nagatomo et al.

FOREIGN PATENT DOCUMENTS

JP 2003-316202 11/2003

OTHER PUBLICATIONS

U.S. Appl. No. 12/204,083, filed Sep. 4, 2008, Fujita et al.
U.S. Appl. No. 12/187,021, filed Aug. 6, 2008, Shono et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A cleanerless image forming apparatus configured to reduce the density unevenness of halftone images. The apparatus includes a photosensitive member, a charging roller device for uniformly charging the surface of the photosensitive member, an optical writing unit for forming latent images on the surface of the photosensitive member after uniform charging, a developing device for developing the latent toner image on the photosensitive member, a transfer unit for transferring the toner image to an intermediate transfer belt, and a brush member for trapping post-transfer residual toner adhering to the surface of the photosensitive member after passing through the transfer process by the transfer unit and before entering the developing process by the developing device, wherein the post-transfer residual toner is recovered within the developing device after re-transfer of the post-transfer residual toner within the brush member to the surface of the photosensitive member.

19 Claims, 8 Drawing Sheets

FIG. 8

| ARITHMETIC MEAN SURFACE ROUGHNESS Ra OF THE PHOTOSENSITIVE MEMBER [μm] | | 0.010 | 0.020 | 0.800 |
|---|---|---|---|---|
| DENSITY UNEVENNESS | INITIAL PRINT | × | △ | × |
| | AFTER OUTPUTTING 5,000 SHEETS | × | × | × |

※ UNDER CONDITIONS IN WHICH THE TONER IS NOT TRAPPED BY THE BRUSH MEMBER
×: DENSITY UNEVENNESS GREATLY IN EXCESS OF THE ALLOWABLE RANGE
△: DENSITY UNEVENNESS SLIGHTLY IN EXCESS OF THE ALLOWABLE RANGE

FIG. 9

| ARITHMETIC MEAN SURFACE ROUGHNESS Ra OF THE PHOTOSENSITIVE MEMBER [μm] | | 0.010 | 0.020 | 0.800 |
|---|---|---|---|---|
| DENSITY UNEVENNESS | INITIAL PRINT | ○ | ○ | ○ |
| | AFTER OUTPUTTING 5,000 SHEETS | × | × | × |

※ WHEN A CLEANING BLADE IS USED INSTEAD OF THE BRUSH MEMBER
×: DENSITY UNEVENNESS GREATLY IN EXCESS OF THE ALLOWABLE RANGE
○: NO DENSITY UNEVENNESS

FIG. 10

| UNIVERSAL HARDNESS HU [N/mm$^2$] | | 80 | 100 | 140 | 200 | 250 |
|---|---|---|---|---|---|---|
| DENSITY UNEVENNESS | INITIAL PRINT | ○ | ○ | ○ | ○ | ○ |
| | AFTER OUTPUTTING 5,000 SHEETS | × | ○ | ○ | ○ | ○ |
| FILMING | INITIAL PRINT | ○ | ○ | ○ | ○ | ○ |
| | AFTER OUTPUTTING 5,000 SHEETS | × | ○ | ○ | ○ | × |

○: NOT DETECTED
×: CLEARLY DETECTED

FIG. 11

| COEFFICIENT OF FRICTION OF THE SURFACE OF THE PHOTOSENSITIVE MEMBER | | 0.2 | 0.3 | 0.4 | 0.5 |
|---|---|---|---|---|---|
| DENSITY UNEVENNESS | INITIAL PRINT | ○ | ○ | ○ | ○ |
| | AFTER OUTPUTTING 5,000 SHEETS | ○ | ○ | × | × |

FIG. 12

| CONTACT ANGLE WITH PURE WATER OF THE PHOTOSENSITIVE MEMBER [° ] | | 85 | 90 | 100 | 110 |
|---|---|---|---|---|---|
| FILMING | INITIAL PRINT | ○ | ○ | ○ | ○ |
| | AFTER OUTPUTTING 5,000 SHEETS | × | ○ | ○ | ○ |

CLEANERLESS IMAGE FORMING APPARATUS

BACKGROUND OF THE INVENTION

1. Field of the Invention

The present invention relates to an image forming apparatus with the so-called cleanerless configuration in which post-transfer residual toner that remains adhering to the surface of the latent image carrier after transfer of the toner image on the latent image carrier to the transfer member is recovered within the developing device.

2. Description of the Related Art

Normally, in an electrophotographic image forming apparatus, images are formed by the following process. First, an electrostatic latent image is formed on a latent image carrier, such as a photosensitive member or the like, that has been uniformly charged, by scanning the latent image carrier with light. Next, the toner image obtained by developing is either directly transferred from the latent image carrier to the recording medium, such as transfer paper or the like, or transferred from the latent image carrier to the recording medium, such as transfer paper or the like, via an intermediate transfer member.

The apparatus disclosed in for example Japanese Patent Application Laid-open No. 2003-316202 is known as an image forming apparatus of this configuration. In this image forming apparatus a toner image formed on the surface of a rotating drum shaped photosensitive member, which is the latent image carrier, is transferred in the primary transfer operation to an intermediate transfer belt at the primary transfer nip where the photosensitive member contacts the intermediate transfer belt. Then, after passing the primary transfer nip, the surface of the photosensitive member is uniformly charged by a charging device. Post-transfer residual toner adheres to the surface of the photosensitive member after passing through the primary transfer nip, but after uniformly charging the surface of the photosensitive member without removing the residual toner, the residual toner is recovered within the developing apparatus, which is the so-called cleanerless configuration.

When the transfer of the toner image from the photosensitive member to the transfer member is properly carried out, virtually all the post-transfer residual toner adhering to the surface of the photosensitive member after passing through the primary nip is oppositely charged toner, which is charged with the opposite polarity to the regular polarity. Therefore the inventors of the present invention made a prototype image forming apparatus using the cleanerless configuration as follows. A bias having the same polarity as the regular polarity of the toner is applied to an electrically conducting brush that contacts the photosensitive member after passing the primary transfer nip. This produces an image forming apparatus in which the oppositely charged toner, which is the majority of the post-transfer residual toner, is trapped within the brush. The post-transfer residual toner trapped within the electrically conducting brush is again transferred from the brush to the photosensitive member by changing the bias conditions immediately after completing the print job, or during the timing between feeding paper in continuous printing, or the like, to achieve recovery within the developing device.

However, it is known that in this configuration, unevenness of the density of halftone images occurs due to the transfer efficiency of the toner image from the photosensitive member to the transfer member. Also, it is known that this unevenness of the density is caused as follows. When the transfer of the toner image from the photosensitive member to the transfer member is properly carried out, the amount of residual toner is comparatively small, virtually all of which is oppositely charged toner. On the other hand when the transfer efficiency is comparatively poor, the amount of post-transfer residual toner is comparatively large, and includes regular polarity toner which is regularly charged in addition to the oppositely charged toner. The regular polarity toner is not trapped by the electrically conducting brush, but remains on the developing area. If the place on the photosensitive member to which the regular polarity toner is adhering when it is returned to the developing area is a comparatively large background area, then the toner is transferred to the developing roller or the like at the developing area and recovered in the developing device, and therefore this is not a big problem. However, if the place on the photosensitive member that is returned to the developing area with regular polarity toner adhering is a small area background portion formed between dots of a halftone image, the toner is affected by the electric field of the surrounding latent image that is in dot form, and remains as it is on the surface of the photosensitive member. In this way, the problem arises that the halftone image is denser in parts.

SUMMARY OF THE INVENTION

With the foregoing in view, it is an object of the present invention to provide a cleanerless image forming apparatus capable of reducing the density unevenness of halftone image.

An image forming apparatus of the present invention comprises a latent image carrier; a charging device configured to uniformly charge an endless moving surface of the latent image carrier; a latent image forming device configured to form a latent image on the surface uniformly charged; a developing device configured to develop the latent image on the surface to obtain a toner image; a transfer device configured to transfer the toner image on the surface to a transfer member; and a toner trapping member configured to trap post-transfer residual toner adhering to the surface of the latent image carrier after passing through transfer processing by the transfer device and before entering developing processing by the developing device. The post-transfer residual toner trapped by the toner trapping member is recovered within the developing device after re-transferring the toner to the surface of the photosensitive member, and the latent image carrier has an arithmetic mean surface roughness Ra equal to or greater than 0.014 μm and equal to or less than 0.60 μm.

BRIEF DESCRIPTION OF THE DRAWINGS

The above and other objects, features, and advantages of the present invention will become more apparent from the following detailed description taken with the accompanying drawings in which:

FIGS. 8 through 12 are tables showing the results of each test for the embodiment.

DESCRIPTION OF THE PREFERRED EMBODIMENTS

The following is an explanation of an embodiment of an electrophotographic color laser printer (hereafter simply referred to as the printer) as an image forming apparatus that applies the present invention.

First, the basic configuration of the printer according to the present embodiment is explained.

Figure 1:
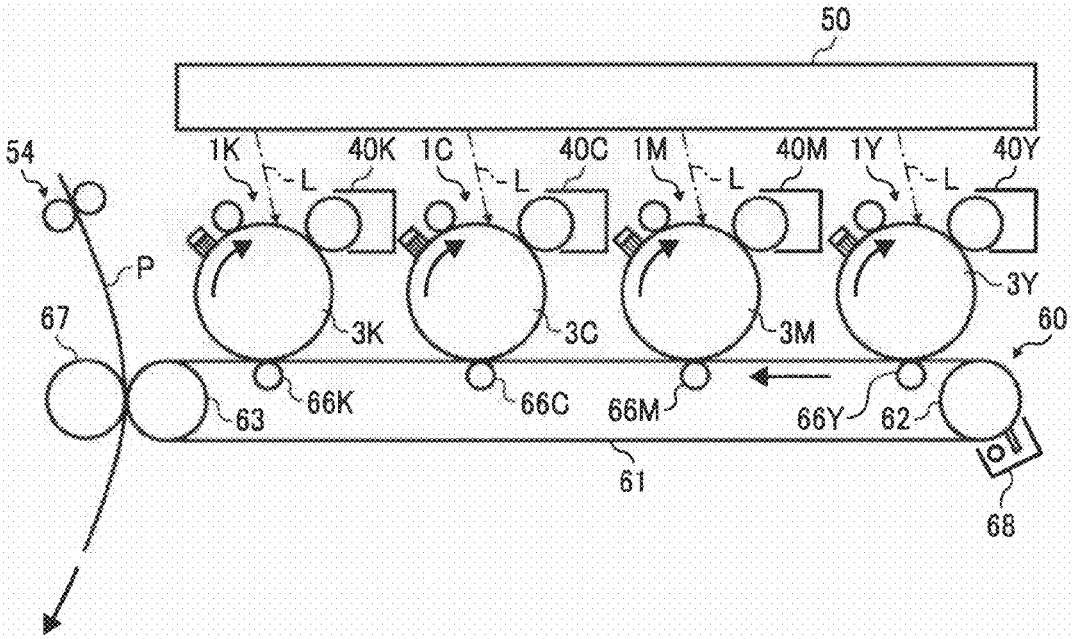
FIG. 1 is a diagram showing the outline constitution of a printer according to an embodiment of the present invention.

FIG. 1 shows the main parts of the printer according to the present embodiment. The printer includes four process units 1Y, M, C, K for forming toner images in each of the colors yellow, magenta, cyan, and black (hereafter referred to as Y, M, C, K). Also, the printer includes an optical writing unit 50, a pair of registration rollers 54, a transfer unit 60, and so on. The letters Y, M, C, K added to the end of a reference numeral indicate that the element is for the yellow, magenta, cyan, or black element respectively.

The optical writing unit 50, which is latent image forming means, includes a light source that includes four laser diodes corresponding to each of the four colors Y, M, C, K, a hexagonal polygon mirror, a polygon motor to rotate the polygon mirror, an fθ lens, a lens, a reflecting mirror, and so on. Laser light L emitted from the laser diodes is reflected by one of the surfaces of the polygon mirror, is deflected as the polygon mirror rotates, and is incident on one of four photosensitive members, which are described later. The surfaces of the four photosensitive members Y, M, C, K are scanned with the laser light L emitted by the four laser diodes respectively.

The process units 1Y, M, C, K include drum-shaped photosensitive members 3Y, M, C, K as latent image carriers, and developing devices 40Y, M, C, K corresponding to the photosensitive members 3Y, M, C, K respectively. The photosensitive members 3Y, M, C, K include base tubes made of aluminum or the like, covered with an organic photosensitive layer. The photosensitive members 3Y, M, C, K are driven to rotate in the clockwise direction shown in the drawing at a predetermined linear speed by drive means, which are not shown on the drawings. Also, Y, M, C, K electrostatic latent images are formed by scanning in the dark with the laser light L that has been generated by the optical writing unit 50, and that has been modulated based on image information transmitted from a personal computer or the like, which is not shown on the drawings.

Figure 2:
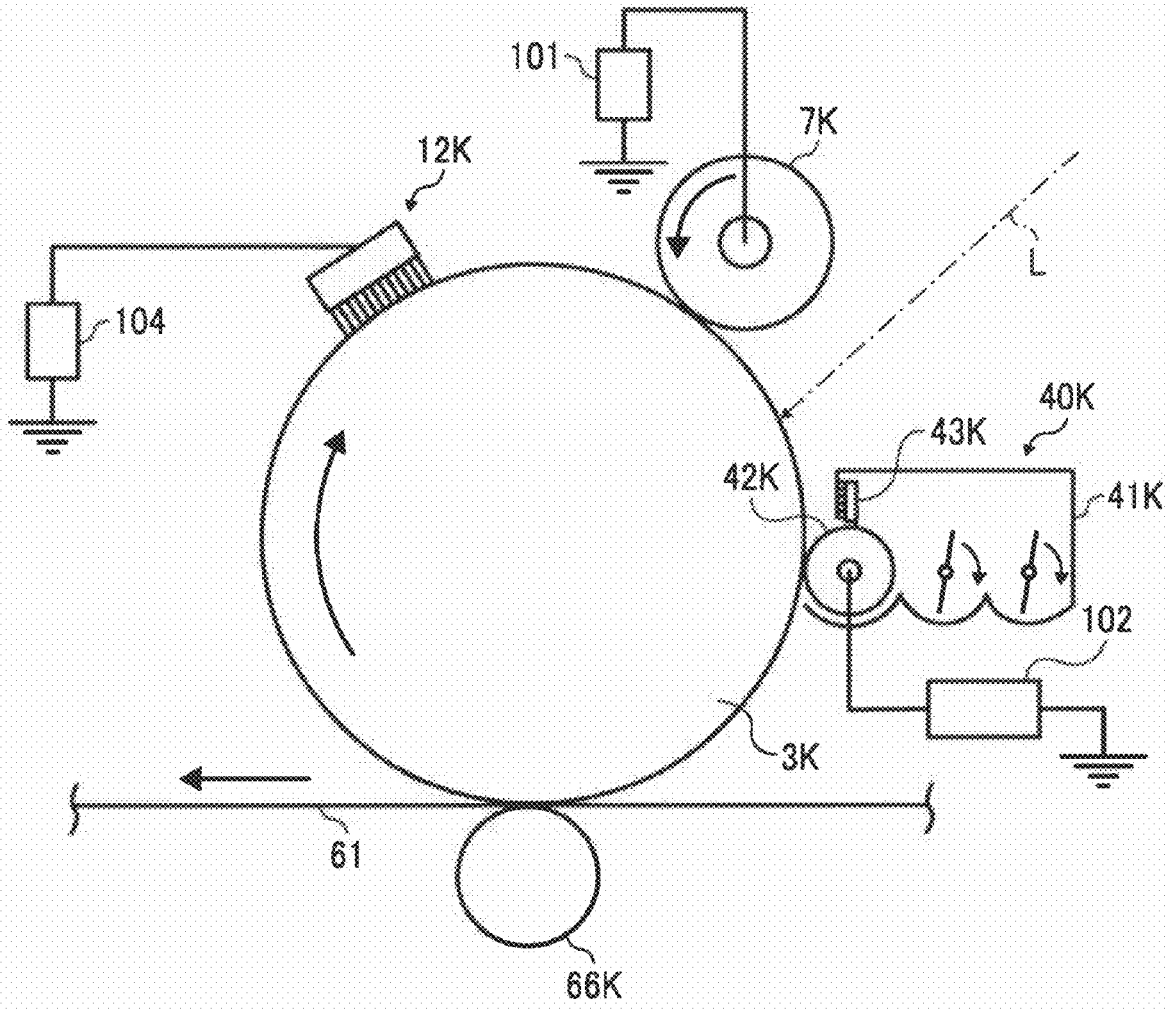
FIG. 2 is a diagram showing the constitution of the K process unit of the same printer.

FIG. 2 shows the K process unit 1K from among the four process units 1Y, M, C, K, together with the surrounding constitution. In FIG. 2, the K process unit 1K includes the photosensitive member 3K, a charging roller 7K, a decharging lamp which is not shown on the drawings, an electrically conducting sheet (not shown in drawings), a brush member 12K, the developing device 40K which is developing means, and so on. The K process unit 1K is supported as a single unit by a common unit housing (support member), which is removable with respect to the main body of the printer.

The K photosensitive member 3K, which is the member that is charged and that carries the latent image, is a drum of about 24 mm diameter, that includes a photosensitive layer made from an organic photoconductive (OPC) material, which can be charged, that covers the surface of an electrically conducting base member made from an aluminum base tube. The K photosensitive member 3K is driven by drive means, which is not shown in the drawings, to rotate at a predetermined linear speed in the clockwise direction as shown on the drawing.

The charging roller 7K is a metal rotating shaft member, the peripheral surface of which is covered by an electrically conducting roller unit made from an electrically conducting rubber or the like. The charging roller 7K is rotated about the rotating shaft member by drive means, which is not shown in the drawings, in the counterclockwise direction on the drawing, and contacts the photosensitive member 3K to form a charging nip. A charging bias is applied to the metal rotating shaft member of the charging roller 7K by a charging power supply 101. Also, by generating discharge between the charging roller 7K and the photosensitive member 3K, the surface of the photosensitive member 3K is uniformly charged to a negative polarity.

The uniformly charged surface of the K photosensitive member 3K is optically scanned by the optical writing unit 50 as described above, to form the K electrostatic latent image (negative polarity and potential lower than the base portion). The electrostatic latent image is developed into a K toner image by the K developing device 40K.

The K developing device 40K includes a developing roller 42K, a part of the peripheral surface whereof is exposed by an aperture provided in a casing 41K. The developing roller 42K rotates while carrying K toner, which is not shown on the drawings and which is housed within the casing 41K, on the peripheral surface of the developing roller 42K. The K toner carried on the surface of the developing roller 42K is transported to a developing position where the developing roller 42K and the photosensitive member 3K are in opposition, or in contact.

At this developing area, a developing potential acts between the developing roller 42K to which a negative polarity developing bias output from a developing power source 102 is applied, and the electrostatic latent image of the photosensitive member 3K. The developing potential acts to electrostatically transfer the negative polarity K toner from the roller to the latent image. Also, a non-developing potential acts between the developing roller 42K and the uniformly charged portion (base portion) of the photosensitive member 3Y, to transfer negative polarity K toner from the base portion to the roller. The K toner on the developing roller 42K separates from the roller and is transferred to the electrostatic latent image of the photosensitive member 3K by the action of the developing potential. As a result of this transfer, the electrostatic latent image on the photosensitive member 3K is developed into a K toner image. The K toner image is transferred in the primary transfer operation onto an intermediate transfer belt 61 of the transfer unit, which is described later, by the rotation of the photosensitive member 3K.

After passing the primary transfer nip and before the contact position of the surface of the photosensitive member 3K with the charging roller 7K and entry into the developing area described above, a trapping nip is formed by contact with the electrically conducting brush of the brush member 12K, as the toner trapping member. The brush member 12K includes an electrically conducting brush constituted by a metal support body and a plurality of bristles made from an electrically conducting material that is fixed to the surface of the support body. The tip of the electrically conducting brush contacts the photosensitive member 3K.

The voltage of the surface of the photosensitive member 3K after passing the primary transfer nip is reduced to between about zero to −20V, due to the effect of the transfer current at the primary transfer nip, and post-transfer residual toner adheres to the surface. The opposite polarity toner contained in this residual toner is trapped within the electrically conducting brush of the brush member 12K to which a bias of the same polarity (in the present example negative) as the regular charging polarity of the K toner by the brush power supply 104. Also, by changing the bias applied to the brush member 12K immediately after a print job is finished, or at a timing between feeding paper in continuous printing, and so on, the toner is again transferred from the electrically conducting brush to the surface of the photosensitive member 3K. Then, after charging to a regular polarity by discharge at the charging nip as described above, the toner is recovered onto developing roller 42K in the developing area. In the present printer, the cleanerless configuration is achieved by this type of recovery.

Methods of expelling the K toner from the brush member 12K immediately after a print job is finished or at a timing between feeding paper in continuous printing, include changing the value or the polarity of the bias applied to the brush member 12K. Also, if a bias in which a direct current voltage is superimposed on an alternating current voltage is applied to the brush member 12K, the frequency of the alternating current voltage may be changed.

The K process unit 1K has been explained, but the constitution of the process units for the other colors 1Y, M, C is the same as that of the K process unit 1K, so their explanation is omitted.

As was indicated in FIG. 1, the transfer unit 60 is disposed below the process units 1Y, M, C, K for each color. In the transfer unit 60, the intermediate transfer belt 61, which is in an endless form, is endlessly rotated in the counterclockwise direction in the drawing, while being tensioned by a plurality of tensioning rollers. Specifically, the plurality of tensioning rollers includes a driven roller 62, a drive roller 63, four primary transfer bias rollers 66Y, M, C, K, and so on.

Each of the driven roller 62, the driven roller 63, and the four primary transfer bias rollers 66Y, M, C, K are in contact with the reverse side (the peripheral surface inside the loop) of the intermediate transfer belt 61. Also, the four primary transfer bias rollers 66Y, M, C, K are rollers made from a metal core covered with an elastic material such as sponge or the like. The four primary transfer bias rollers 66Y, M, C, K press towards the photosensitive members 3Y, M, C, K, with the intermediate transfer belt 61 sandwiched in between. In this way, four primary transfer nips for the colors Y, M, C, K are formed by the four photosensitive members 3Y, M, C, K contacting the intermediate transfer belt 61 over a predetermined length in the direction of movement of the belt.

A constant current controlled primary transfer bias is applied to the metal cores of the four primary transfer bias rollers 66Y, M, C, K by their respective transfer bias power supplies, which are not shown in the drawings. In this way, transfer charge is applied to the reverse side of the intermediate transfer belt 61 via the four primary transfer bias rollers 66Y, M, C, K. A transfer electric field is formed between the intermediate transfer belt 61 and photosensitive members 3Y, M, C, K at each primary transfer nip. In the present printer, the primary transfer bias rollers 66Y, M, C, K are provided as primary transfer means, however instead of rollers, brushes, blades, or the like, may be used.

The Y, M, C, K toner images formed on the photosensitive members 3Y, M, C, K for each of the colors are transferred and superimposed onto the intermediate transfer belt 61 at the primary transfer nip for each color. In this way, a four color superimposed toner image (hereafter referred to as the four color toner image) is formed on the intermediate transfer belt 61.

A secondary transfer nip is formed at the position where a secondary transfer bias roller 67 contacts the front surface of the intermediate transfer belt 61 where the belt is rotated by the drive roller 63. A secondary transfer bias is applied to the to the secondary transfer bias roller 67 by voltage application means, which includes a power supply and wiring which is not shown in the drawings. In this way, a secondary transfer electric field is formed between the secondary transfer bias roller 67 and a secondary transfer nip reverse side roller 63. The four color toner image formed on the intermediate transfer belt 61 is transported into the secondary transfer nip by the endless movement of the belt.

The present printer is provided with a sheet supply cassette, which contains a plurality of recording sheets P stacked in the form of a bundle of recording sheets. Also, the topmost recording sheet P is fed into a sheet supply path at a predetermined timing. The recording sheet P is fed into a registration nip of a pair of registration rollers 54 disposed at the end of the sheet supply path.

Both rollers of the pair of registration rollers 54 are rotated in order to feed the recording sheet P fed from the sheet supply cassette into the registration nip. However, as soon as the leading edge of the recording sheet P is fed in, the rotation of both rollers is stopped. Also, the recording sheet P is fed into the secondary transfer nip at a timing synchronized with the four color toner image on the intermediate transfer belt 61. At the secondary transfer nip, the four color toner image on the intermediate transfer belt 61 is transferred in one secondary transfer operation onto the recording sheet P by the action of the secondary transfer electric field and the nip pressure, to give a full color image in consonance with the white color of the recording sheet P.

After the recording sheet P on which the full color image has been formed in this way has been discharged from the secondary transfer nip, the recording sheet P is fed to a fixing device, which is not shown on the drawings, and the full color image is fixed.

Secondary post-transfer residual toner adhering to the surface of the intermediate transfer belt 61 after passing the secondary transfer nip is removed from the surface of the belt by a belt cleaning device 68.

In the present printer having the basic configuration as described above, the four photosensitive members 3Y, M, C, K function as latent image carriers that carry latent images on their surfaces, which are endlessly moving due to the rotation. Also, the optical writing unit 50 functions as latent image forming means for forming latent images on the surfaces of the uniformly charged photosensitive members. Also, the process units for each color function as developing means for developing the latent images on the surfaces of the photosensitive members 3Y, M, C, K to obtain toner images. Also, the transfer unit 60 functions as transfer means for transferring the Y, M, C, K toner images on the surfaces of the photosensitive members 3Y, M, C, K onto the intermediate transfer belt 61, which is the transfer member. Also, the brush member in the process unit of each color functions as a toner trapping member for trapping post-transfer residual toner adhering to the surface of the photosensitive members, after passing through the transfer process by the transfer unit 60 and before entering the developing process by the developing device.

Next, tests carried out by the three inventors are explained.

First, a prototype printer having the same constitution as the printer according to the present embodiment shown in FIGS. 1 and 2 was prepared. Also, several types of photosensitive member 3K each having different arithmetic mean surface roughnesses Ra (JIS B 0601-1994) were prepared as photosensitive members 3K to be mounted in the K process unit 1K. Also, 5000 copies of a monochrome halftone chart (halftone gradation image) were printed at an image area ratio of 5% on A4 sheets for each of the photosensitive members 3K, by successively changing the photosensitive member 3K mounted in the prototype machine. Based on the results of observation of the magnified images, the presence or absence of density unevenness in the halftone chart was evaluated.

Density unevenness was measured by measuring the image density at 10 or more points within the halftone chart using a reflective type densitometer manufactured by X-Rite Corporation. If the measured result (L*) was 85 or higher it was taken to mean there was no density unevenness, and for less than 85 it was taken to mean that there was density unevenness.

During continuous printing, the process linear speed, which was the linear speed of the photosensitive members 3Y, M, C, K for each color and the intermediate transfer belt 61, was set to 100 mm/sec.

A 6 mm diameter rotating shaft member whose surface was covered with a roller member made from an electrically conducting rubber having an outer diameter of 10 mm was used as the charging roller 7K.

The brush member 12K was a metal support body to the surface of which a brush portion formed from a plurality of bristles made from an electrically conducting material was fixed. The brush portion was made to contact the surface of the photosensitive member 3K. The plurality of bristles was made from electrically conducting fibers each cut to a predetermined length. Examples of material for the bristles include resin materials such as nylon 6 (registered trademark), nylon 12 (registered trademark), acryl, vinylon, and polyester. The resin material is made electrically conducting by dispersing electrically conducting powder, such as carbon or metal powder, within the resin material.

K toner manufactured by the pulverization method with an average particle diameter of 8.5 μm to which an external additive was added was used as K toner.

A charging bias of −1100V was applied to the charging roller 7K, to uniformly charge the photosensitive member 3K to about −900V. This voltage is maintained until just before entering the primary transfer nip. However, after passing the primary transfer nip, the voltage of the surface of the photosensitive member 3K is reduced down to about −20V, due to the effect of the transfer current of the transfer nip. Also, the developing bias applied to the developing roller 42K was −250V. Also, the bias applied to the brush member 12K was −500V.

Figure 3:
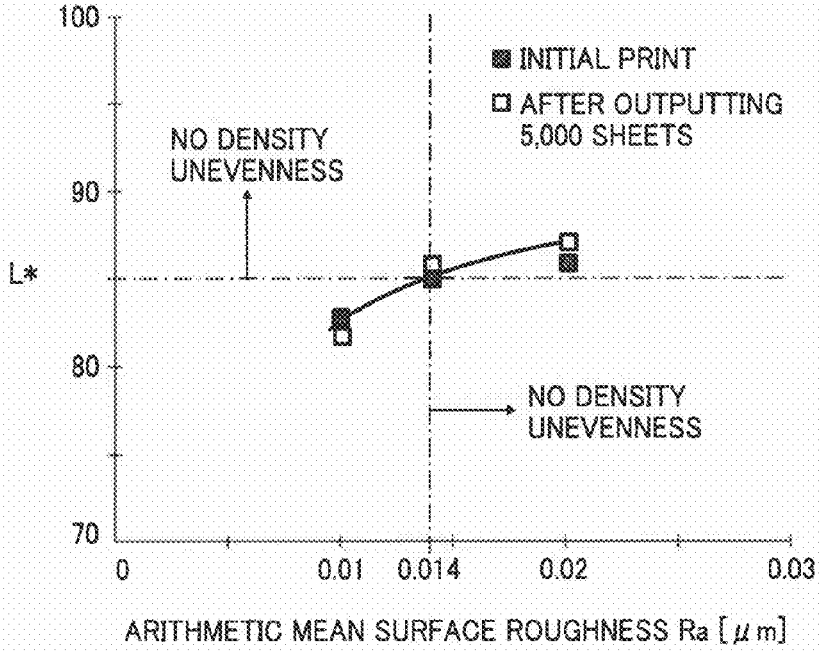
FIG. 3 is a graph showing the relationship between L* of a halftone chart and the arithmetic mean surface roughness Ra of the photosensitive member (low roughness region)
Figure 4:
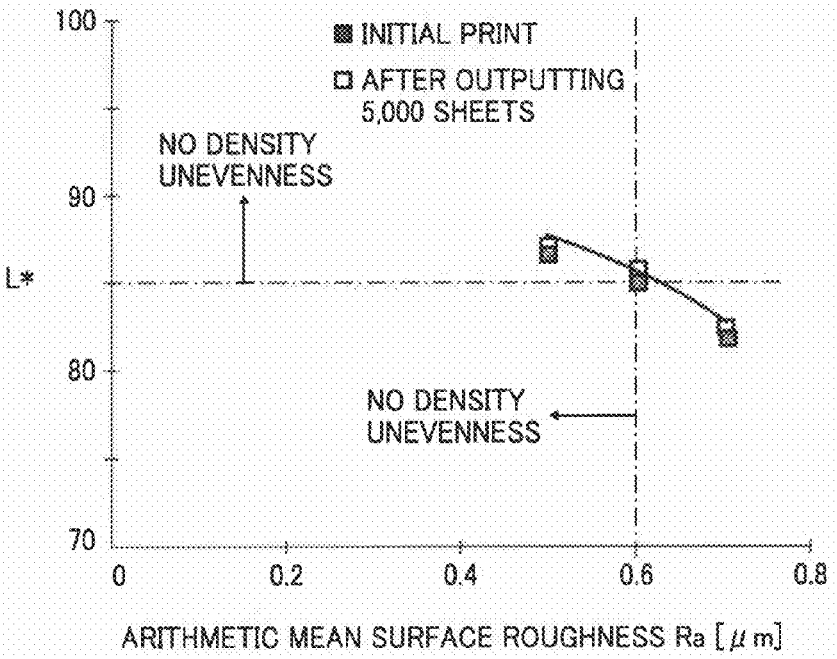
FIG. 4 is a graph showing the relationship between L* of a halftone chart and the arithmetic mean surface roughness Ra of the photosensitive member (high roughness region)

The test results under these conditions are shown in FIGS. 3 and 4. In these figures, the black square points show the density (L*) of the halftone images at the start of the test for the first 100 prints from the start of printing (hereafter referred to as the initial print). The white open square points show the density (L*) of the halftone image of the 5,000$^{th}$ printed sheet.

Figure 5:
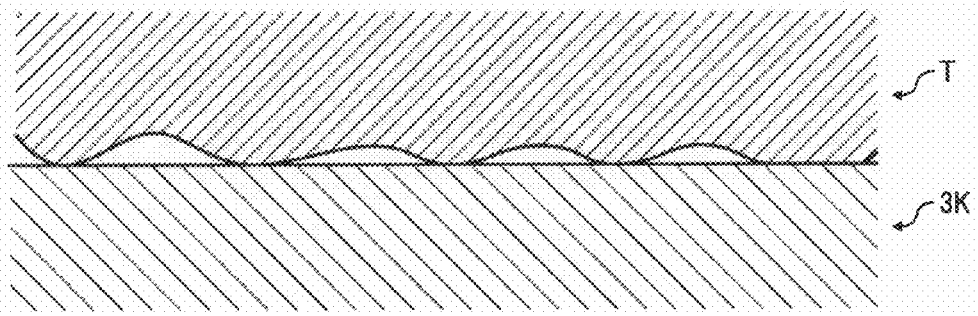
FIG. 5 is a schematic diagram showing the relationship between a photosensitive member whose arithmetic mean surface roughness Ra is too small and toner particles.

As shown in FIG. 3, when the arithmetic mean surface roughness Ra of the photosensitive member 3K is in the range 0.01 through 0.03 μm, the smaller the arithmetic mean surface roughness Ra the greater the density unevenness (L* less than 85). Furthermore, when the arithmetic mean surface roughness Ra is equal to or greater than 0.014 μm, density unevenness does not occur in the halftone chart from the initial print through to the 5,000$^{th}$ print. The following is thought to be the explanation for the reason that when the arithmetic mean surface roughness Ra is in the range 0.01 through 0.03 μm, the smaller the arithmetic mean surface roughness Ra the greater the density unevenness. As shown in FIG. 5, when the surface of the photosensitive member 3K is too smooth with respect to the toner particles T, which have fine undulations, almost all the convex portions of the toner particles T contact the surface of the photosensitive member 3K. As a result, the adhesion forces between the toner particles T and the surface of the photosensitive member 3K (Van der Waals forces and image forces) are increased. In this way it is thought that at the primary transfer nip, it becomes difficult for the regular polarity toner particles T to transfer to the intermediate transfer belt.

Figure 6:
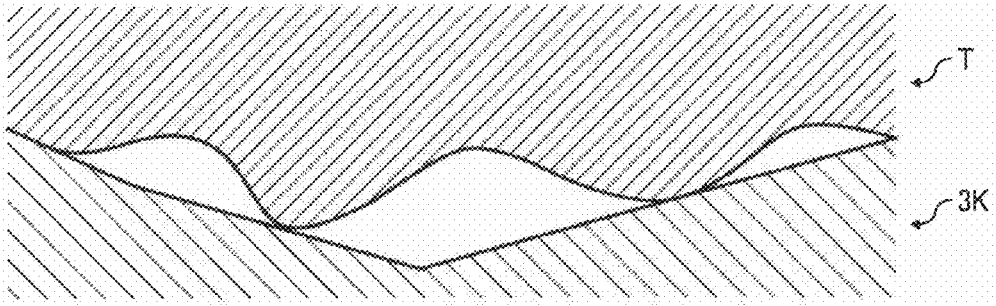
FIG. 6 is a schematic diagram showing the relationship between a photosensitive member whose arithmetic mean surface roughness Ra is too large and toner particles.

On the other hand, as shown in FIG. 4, when the arithmetic mean surface roughness Ra of the photosensitive member 3K is in the range 0.400 through 0.800 μm, the larger the arithmetic mean surface roughness Ra the greater the density unevenness (L* less than 85). Furthermore, when the arithmetic mean surface roughness Ra is equal to or less than 0.60 μm, density unevenness does not occur in the halftone chart from the initial print through to the 5,000$^{th}$ print. The following is thought to be the explanation for the reason that when the arithmetic mean surface roughness Ra is in the range 0.400 through 0.800 μm, the larger the arithmetic mean surface roughness Ra the greater the density unevenness. As shown in FIG. 6, within this range, even though the surface of the photosensitive member 3K is too rough with respect to the toner particles T, which have fine undulations, almost all the convex portions of the toner particles T contact the surface of the photosensitive member 3K. As a result, the adhesion forces between the toner particles T and the surface of the photosensitive member 3K are increased.

Figure 7:
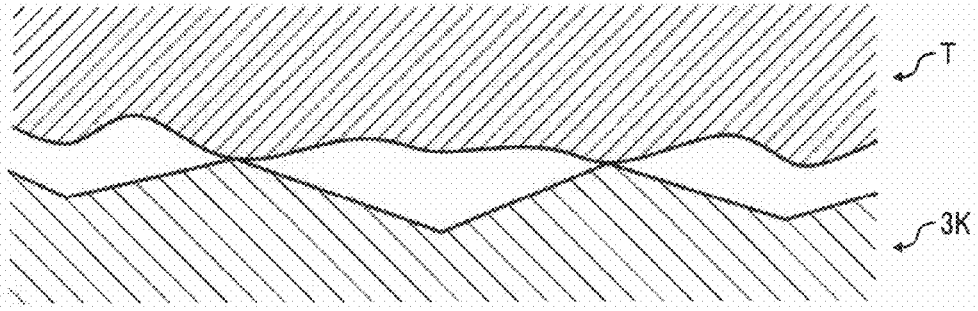
FIG. 7 is a schematic diagram showing the relationship between a photosensitive member whose arithmetic mean surface roughness Ra is appropriate and toner particles.

In FIGS. 3 and 4, the density unevenness results for arithmetic mean surface roughness Ra in the range 0.021 through 0.400 μm are not plotted. However, when test printing was carried out with not less than 10 different kinds of photosensitive members each with different arithmetic mean surface roughness Ra in this range, in all cases density unevenness did not occur. As shown in FIG. 7, in this range, the surface of the photosensitive member 3K is in the appropriate range with respect to the toner particles T, which have fine undulations. Therefore, the toner particles T contact the surface of the photosensitive member 3K at only a fraction of the convex portions.

Next, the inventors carried out similar tests under the condition that a bias was not applied to the brush member 12K (GND), in other words under the condition that the residual toner is not trapped by the brush member 12K. The tests were carried out using three types of K process units having photosensitive members 3K with arithmetic mean surface roughness Ra of 0.010, 0.020, and 0.800 μm. The printed sheets were examined to determine whether scumming (adherence of toner on non-image areas) had occurred. The results are shown in FIG. 8.

As shown in FIG. 8, scumming was detected in the non-image parts around the halftone chart for all three types. Opposite polarity toner in the post-transfer residual toner was not trapped by the brush member 12K, but was re-transported as it was to the developing area, so scumming occurred. In the tests described above, during the 5,000 sheet continuous print run, a negative bias was continuously applied to the brush member 12K so toner with the opposite polarity was continuously trapped by the brush member 12K. However, scumming did not occur. The quantity of opposite polarity toner per printed sheet is small, so even in the 5,000 sheet continuous print run, opposite polarity toner was not taken from the brush member 12K.

Next, a cleaning blade was installed instead of the brush member 12K, and the same tests as the first set of tests was carried out. The results are shown in FIG. 9.

As shown in FIG. 9, in the initial print, density unevenness and scumming did not occur for all three types of photosensitive member 3K. This is because by cleaning the residual toner with the cleaning blade, re-transporting opposite polarity toner and regular polarity toner to the developing area was avoided. However, after printing the 5,000 sheets, in all three types of photosensitive member 3K, density unevenness that greatly exceeded the allowable range occurred, caused by defective cleaning of the residual toner due to wear of the cleaning blade.

Next, the same tests as the first set of tests was carried out using several photosensitive members with arithmetic mean surface roughness Ra slightly smaller than 0.600 μm as the photosensitive member 3K, and toner with an average particle diameter smaller than 8.5 μm as the K toner. In all cases it was possible to avoid density unevenness in the halftone chart, but the larger the average diameter of the toner used, the more the value of L* approached close to the limit of the allowable range (85).

Therefore, the relationship between the arithmetic mean surface roughness Ra and the average particle diameter of the toner was investigated. It was found that when the arithmetic mean surface roughness Ra is equal to or less than the average particle diameter of the toner multiplied by 0.06, even when toner with extremely small average particle diameter is used, it was possible to obtain L* the same as when toner with an average particle diameter of 8.5 μm (hereafter referred to as small particle toner) is used. In other words, if the arithmetic mean surface roughness Ra is equal to or less than the average particle diameter of the toner multiplied by 0.06, it is possible to reduce the density unevenness to the same level as when using small particle diameter toner, even when using extremely small particle diameter toner.

Next, the same tests as the first set of tests was carried out using five types of photosensitive members each with different arithmetic mean surface roughness Ra and different universal hardness HU, as the photosensitive member 3K. In addition to density unevenness of the halftone chart, the photosensitive members 3K were examined for the presence of adherence of toner (filming). The arithmetic mean surface roughness Ra for the five types of photosensitive members 3K was in the range 0.014 through 0.600 μm. Also, the universal hardness HU was measured as follows. The universal hardness HU was measured when a Vickers square pyramid diamond indenter is pressed into the surface with a maximum force of 6 mN, in an environment of 25° C. temperature and 50% humidity. The results are shown in FIG. 10.

As shown in FIG. 10, in the initial print, neither density unevenness nor filming occurred under any of the conditions. However, when the photosensitive member 3K with the universal hardness HU of 80N/mm$^2$ was used, halftone chart density unevenness occurred in the 5,000$^{th}$ printed sheet. This was because the surface of the photosensitive member 3K became gradually worn due to friction with the brush member 12K during the printing operation, so in the latter part of the printing operation the arithmetic mean surface roughness Ra became less than 0.014.

On the other hand, when the photosensitive member 3K with the universal hardness HU of 250N/mm$^2$ was used, filming was detected on the photosensitive member 3K after the 5,000$^{th}$ printed sheet. This is because for a universal hardness HU greater than 200 N/mm$^2$, it becomes very difficult for toner adhering to the photosensitive member 3K to peel off.

Next, the same tests as the first set of tests was carried out using four types of photosensitive members as the photosensitive member 3K, each with different arithmetic mean surface roughness Ra and coefficients of friction. The arithmetic mean surface roughness Ra of the four types of photosensitive member 3K were in the range 0.014 through 0.600. The results are shown in FIG. 11.

As shown in FIG. 11, in the cases where the coefficient of friction of the photosensitive members 3K was 0.2 and 0.3, no halftone chart density unevenness occurred up to the 5,000$^{th}$ printed sheet. However, in the cases where the coefficient of friction was 0.4 and 0.5, density unevenness was detected in the latter stages of the print run. When the coefficient of friction of the surface of the photosensitive member 3K exceeds 0.3, the surface of the photosensitive member 3K becomes gradually worn during the printing operation, due to friction with the brush member 12K or the like. Therefore in the latter stages of the print run, the arithmetic mean surface roughness Ra became less than 0.014.

Next, the same tests as the first set of tests was carried out using four types of photosensitive members, each with different arithmetic mean surface roughness Ra and different angles of contact with pure water, as the photosensitive member 3K. Also, the photosensitive members 3K were examined for the presence of filming. The arithmetic mean surface roughness Ra of the four types of photosensitive member 3K were in the range 0.014 through 0.60. Also, the angle of contact with pure water was measured using a type CA-DT. A contact angle meter manufactured by Kyowa Interface Science Co., Ltd., by the liquid drop method (in accordance with the instruction manual of the contact angle meter). The results are shown in FIG. 12.

As shown in FIG. 12, in the cases where the contact angle with pure water was 90, 100, and 110° for the photosensitive member 3K, filming did not occur on the photosensitive member 3K up to the 5,000$^{th}$ print. However, in the case where the contact angle with pure water was 85°, filming was detected in the latter stages of the print run. This is because for contact angles with pure water less than 90°, it becomes difficult for toner adhering to the photosensitive member 3K to peel off.

Next, the characteristic constitution of the present printer is explained.

Based on the above tests, the present printer uses photosensitive members 3Y, M, C, K for each of the colors that satisfy all of the following conditions.

- The arithmetic average surface roughness Ra is equal to or greater than 0.014 μm.
- The arithmetic average surface roughness Ra is equal to or less than 0.600 μm, and equal to or less than the product of the average particle diameter of the toner multiplied by 0.06.
- The universal hardness HU in an environment of 25° C. and 50% humidity is equal to or greater than 100 N/mm$^2$, and equal to or less than 200 N/mm$^2$.
- The surface coefficient of friction is 0.3 or less.
- The contact angle of the surface with pure water is equal to or greater than 90°.

Besides these conditions, preferably the following conditions are satisfied by the photosensitive member. When measuring the arithmetic mean surface roughness Ra, the number of convex portions on the surface should be within the range 7 through 15/μm$^2$. This is because if there are not less than seven convex portions per 1 μm$^2$, and of several concave portions are worn away with time, there will be an insufficient number of convex portions and the transfer efficiency will be reduced. Also, if the number of convex portions per 1 $\mu m^2$ is more than 15, it will be difficult to achieve an arithmetic mean surface roughness Ra in the range 0.014 through 0.600 μm.

Next, examples in which a more characteristic constitution is added to the printer according to the present embodiment are explained. Unless stated otherwise below, the constitution of the printer according to each example is the same as that of the present embodiment.

FIRST EXAMPLE

In the printer according to the first example, a slanting bristle brush member that includes a support body made from a metal plate and a plurality of bristles made from an electrically conducting material fixed in a slanting attitude to the surface of the support body was used as the brush member in the process units 1Y, M, C, K of each color. Slanting attitude means an attitude that is slanted with respect to the line normal to the surface of the support body. The slanting bristle member of the brush member with this constitution contacts the photosensitive member with an attitude in which relative to the root of the bristles, the tip of the bristles are inclined towards the downstream side in the direction of movement of the photosensitive member. In other words, the side surface near the tip of the bristles contacts the surface of the photosensitive member with the tip of the bristles inclined towards the downstream side in the direction of movement of the photosensitive member. In this constitution, it is possible to reduce the wear of the photosensitive member compared with the case where tip of the bristles are inclined towards the upstream side in the direction of movement of the photosensitive member, or the so-called counter-direction.

SECOND EXAMPLE

Figure 13:
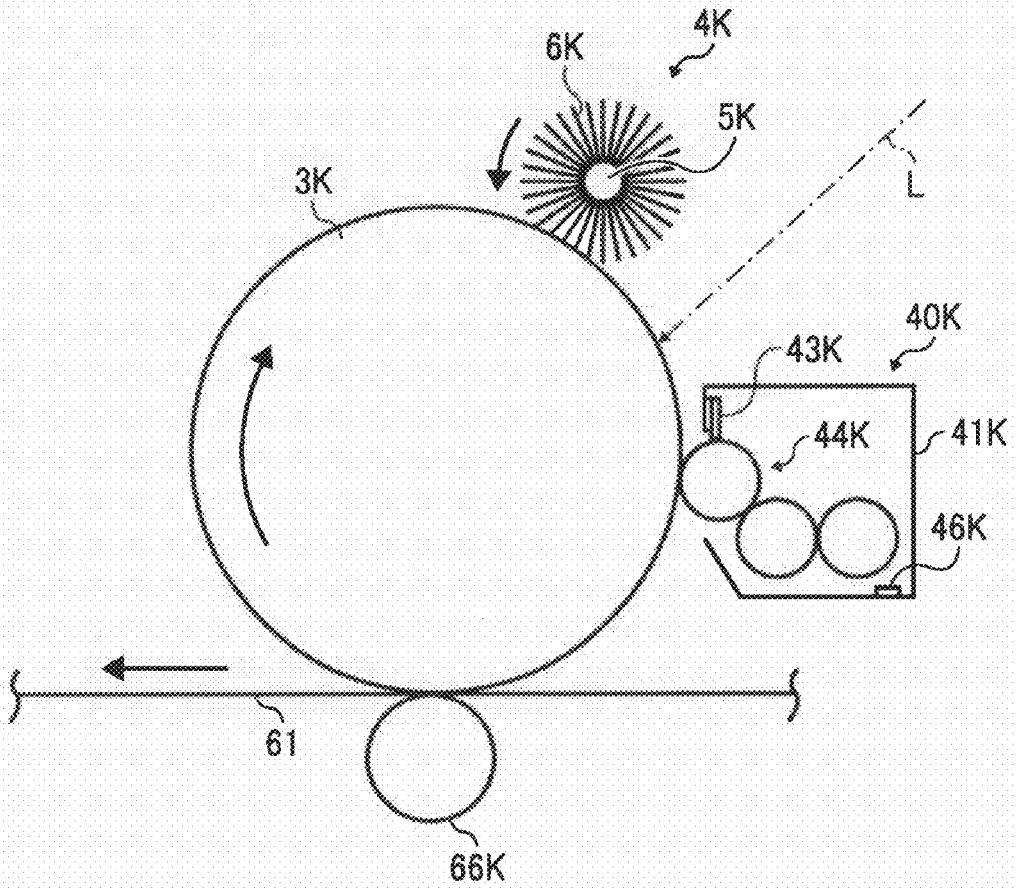
FIG. 13 is a diagram showing the constitution of the K process unit of a printer according to the second example of the present embodiment.

FIG. 13 shows the K process unit of a printer according to this second example. In this printer, the two component developing method using two component developing agent is adopted for the developing device 40K.

In this figure, the K developing device 40K includes a developing roller 44K, a part of the peripheral surface of which is exposed by the aperture provided in the casing 41K. The developing roller 44K includes a developing sleeve made from a non-magnetic pipe that is rotated by drive means, which is not shown in the drawings, and a magnet roller which is not shown in the drawings, which is provided within the developing sleeve and which does not rotate together with the developing sleeve. The casing 41K contains K developing agent that includes magnetic carrier and negative charging K toner. Charging of the K toner is promoted by agitation and transport of the K developing agent in the direction normal to the plane of the paper by two screw members. The K toner is attracted to and scooped up onto the surface of the rotating developing sleeve of the developing roller 44K by the magnetic force of the magnet roller within the developing roller 44K. Then, after the layer thickness is restricted by passing a position in opposition to a developing doctor blade 43K as the developing sleeve rotates, the developing agent is transported to the developing area in opposition to the photosensitive member 3K.

A toner density sensor 46K made from a magnetic permeability sensor is fixed to the bottom plate of the casing 41K, and outputs a voltage whose value corresponds to the magnetic permeability of the K developing agent housed within the casing 41K. The magnetic permeability of the developing agent has a good correlation with the density of the toner in the developing agent, so the toner density sensor 46K outputs a voltage whose value corresponds to the density of the K toner. The value of this output voltage is transmitted to a toner replenishment control unit, which is not shown in the drawings.

The toner replenishment control unit includes memory means, such as RAM or the like. Data on the target value of the output voltage from the K toner density sensor 46K, K-Vtref, and target values of the output voltage from the toner density sensors in the other developing devices, Y, M, C-Vtref, are stored in the memory means. For the K developing device 40K, the value of the voltage output by the toner density sensor 46K is compared with the K-Vtref, and a K toner density replenishment device, which is not shown in the drawings, is operated for just the time corresponding to the comparison result. In this way, replenishment K toner is supplied within the developing device 40K. By controlling (toner replenishment control) the K toner replenishment device in this way, an appropriate amount of K toner is supplied to the K developing agent for which the K toner density had been reduced due to developing. Therefore the density of K toner in the K developing agent within the developing device 40K is maintained within a predetermined range. The same toner replenishment control is implemented in the developing devices of the process units for the other colors.

Also, in the present printer, instead of the fixed brush member, a freely rotatable charging brush roller 4K is provided. The charging brush roller 4K, which is a rotating brush roller, includes a metal rotation shaft member 5K rotatably supported by a bearing, which is not shown on the drawings, and a plurality of bristles (electrically conducting fibers) 6K fitted to the surface of the metal rotation shaft member 5K. Also, a brush roller member is formed by the bristles 6K on the rotation shaft member 5K. The charging brush roller 4K is rotated about the rotation shaft member 5K in the counter-clockwise direction on the drawing by drive means, which is not shown on the drawings, with the tops of the bristles 6K of the brush roller member rubbing against the photosensitive member 3K. The metal rotation shaft member 5K is connected to a charging power supply, which is not shown on the drawings.

The charging brush roller 4K also functions as charging means, so a charging roller for uniformly charging the photosensitive member is not provided. A charging bias in which an alternating current voltage is superimposed on a negative polarity direct current voltage is applied to the rotation shaft member 5K of the charging brush roller 4K by the charging power supply. Also, by causing discharge between the bristles of the charging brush roller 4K and the photosensitive member 3K, the photosensitive member 3K is uniformly charged to a voltage slightly lower than the direct current component (the superimposed direct current voltage) of the charging bias. The average value of the surface voltage of the bristles in the charging brush roller 4K to which the charging bias has been applied is virtually the same as the direct current component of the charging bias. Therefore, if for example a direct current voltage of −900V applied to the alternating current voltage is adopted as the charging bias, the surface of the photosensitive member 3K is uniformly charged to −750V. The alternating current voltage is adopted so that even when the peak is on the positive side, the polarity of the superimposed bias is negative. More specifically, in the present example an amplitude less than 900V (peak to peak voltage 1800V) is adopted. Therefore, virtually all the oppositely charged toner contained in the post-transfer residual toner becomes charged to regular polarity by the discharge. However, a very small quantity of oppositely charged toner is transferred into the brush before being charged to regular polarity. In this case, the discharge from the brush to the photosensitive member passes the oppositely charged toner, so the oppositely charged toner is difficult to become charged to regular, and stays trapped within the brush.

The oppositely charged toner is expelled from the brush by changing the direct current voltage or the alternating current voltage of the charging bias applied to the charging brush roller 4K immediately after completion of the print job, or at a timing between feeding sheets in a continuous print job, or the like.

The following may be used as the drive means for rotating the charging brush roller 4K. Means for varying the rotation speed of the charging brush roller is used, so that the state of slanting of the bristles of the brush roller member in contact with the photosensitive member 3K is varied with time at the time that the post-transfer residual toner is being expelled from the charging brush roller 4K to the photosensitive member 3K. In this constitution, by varying the state of slanting of the bristles of the brush roller member with time, the position of contact of the bristles with the photosensitive member 3K is varied, which imparts small vibrations to the bristles, which promotes the expulsion of the post-transfer residual toner from the charging brush roller.

The process unit for each color is provided with impelling means for impelling the rotation brush roller towards the photosensitive member, so that the amount by which the charging brush roller is impelled towards the photosensitive member is less during the time that the post-transfer residual toner is being trapped on the charging brush roller than during the time that the post-transfer residual toner is being expelled from the charging brush roller to the surface of the photosensitive member. In this constitution, during the time that the post-transfer residual toner is being trapped, by making the charging brush roller contact the photosensitive member with excess pressure, it is possible to avoid the occurrence of faulty trapping of the toner onto the brush or charging the toner from the brush. Also, during the time that the post-transfer residual toner is being expelled, by making the charging brush roller contact the photosensitive member with stronger pressure, it is possible to improve the effect of removal of the toner from the brush, and increase the efficiency of expelling the toner. In the printer according to the present embodiment, it is preferable that same impelling means is provided, even if the brush member is adopted.

A power supply that can vary the frequency of the alternating current voltage during the time that the post-transfer residual toner is being trapped on the brush, and during the time that the post-transfer residual toner is being expelled from the brush is used as the charging power supply 101 that applies the charging bias to the charging brush roller. In this constitution, by varying the frequency from one suitable for trapping to one suitable for expelling, it is possible to promote the expulsion of the toner.

In the printer according to the present embodiment as described above, a photosensitive member whose surface has seven or more and 15 or less minute convex portions per $\mu m^2$, is used for each of the colors. Therefore, for the reasons stated above, it is easy to achieve an arithmetic mean surface roughness Ra in the range 0.014 through 0.600 μm.

Also, in the printer according to the present embodiment, the arithmetic mean surface roughness Ra of the photosensitive member for each color is equal to or less than the average particle diameter of the toner multiplied by 0.06. Therefore, as stated previously, it is possible to reduce density unevenness even when extremely small particle diameter toner is used, in the same way as when small particle diameter toner is used.

Also, in the printer according to the first example as described above, a brush member that includes a support body and a slanting bristle brush member that includes and a plurality of bristles that is fixed in a slanting attitude to the surface of the support body is used as the brush member as a toner trapping member. In addition, the brush member contacts the photosensitive member with an attitude such that relative to the root of the bristles, the tip of the bristles are inclined towards the downstream side in the direction of movement of the photosensitive member. In this constitution, as has been stated previously, it is possible to reduce the wear of the photosensitive member compared with the case where the slanting bristle brush member is made to contact the photosensitive member in the counter direction.

Also, in the printer according to the present embodiment, the transfer unit 60 is used as transfer means, in which after transferring the toner images on the photosensitive members for each color onto the intermediate transfer belt 61 as intermediate transfer member, the toner images are transferred to the recording sheets as recording member. In this configuration, it is possible to reduce wear of the photosensitive members compared with a configuration in which there is direct transfer from the photosensitive members to the recording sheets. Also, a configuration in which the toner images are successively transferred from a first intermediate transfer member to a second intermediate transfer and then to the recording sheets may also be used.

Also, in the printer according to the present embodiment, photosensitive members for each color are used for which the universal hardness is within the range 100 through 200N/$mm^2$, as obtained in a hardness test in which under an environment with a temperature 25° C. and 50% humidity a Vickers square pyramid diamond indenter is pressed into the surface with a maximum force of 6 mN. In this configuration, as has been stated previously, it is possible to reduce the occurrence of density unevenness due to wear of the photosensitive member caused by the universal hardness being too low. In addition, it is possible to reduce the occurrence of filming on the photosensitive member due to the universal hardness being too high.

Also, in the printer according to the present embodiment, photosensitive members having a surface coefficient of friction equal to or less than 0.3 are used for each color. Therefore, as has been stated previously, it is possible to reduce the occurrence of density unevenness due to wear of the photosensitive member caused by the surface coefficient of friction being too high.

Also, in the printer according to the present embodiment, photosensitive members having a contact angle with pure water of 90° or greater are used for each color. Therefore, as has been stated previously, it is possible to reduce the occurrence of filming on the photosensitive member due to the contact angle with pure water being too small.

Also, in the printer according to the second example, a charging brush roller, which is a rotating brush roller, having a rotatable shaft member and a brush roller member having a plurality of bristles fitted to the peripheral surface of the rotatable shaft member as support member, is used as a trapping member for toner of each color. The charging brush roller contacts the surface of the photosensitive member, and also functions as a charging member for uniformly charging the surface of the photosensitive member. In this configuration, it is possible to avoid increasing the cost due to providing a dedicated charging member for uniformly charging the photosensitive member.

Also, in the printer according to the second example, drive means for varying the state of slant of the bristles of the charging brush roller in contact with the photosensitive member by varying the rotation speed of the charging brush roller when expelling post-transfer residual toner from the charging brush roller to the surface of the photosensitive member is used as drive means for rotating the charging brush roller. In this configuration, it is possible to promote the expulsion of post-transfer residual toner from the charging brush roller by varying the position of contact of the bristles with the photosensitive member, and inducing small vibrations in the bristles.

Also, in the printer according to the second example, impelling means for impelling the charging brush roller towards the photosensitive member is provided, so that the amount by which the charging brush roller is impelled towards the photosensitive member is smaller during the time that the post-transfer residual toner is being trapped on the charging brush roller than during the time that the post-transfer residual toner is being expelled from the charging brush roller to the surface of the photosensitive member. In this configuration, it is possible to avoid the occurrence of faulty trapping of toner in the brush or charging of the toner from the brush, by making the charging brush roller contact the photosensitive member with an excess pressure, during the time that the charging brush roller is trapping post-transfer residual toner. Furthermore, it is possible to improve the effect of removing the toner from the brush by making the brush and the photosensitive member contact with a stronger pressure, during the time that the toner is being expelled.

Also, in the printer according to the second example, the charging power supply 101 is provided as bias application means for applying a bias that includes at least an alternating current voltage to the charging brush roller. Therefore it is possible to reduce unevenness of charging of the photosensitive member by repeatedly decharging and charging in a short period of time the photosensitive member by the vibrations of the alternating current component.

Also, in the printer according to the second example, a power supply that varies the frequency of the alternating current voltage during the time that the post-transfer residual toner is being trapped by the charging brush roller, and during the time that it is being expelled from the charging brush roller to the surface of the photosensitive member is used as the charging power supply 101. Therefore, it is possible to promote expulsion of the toner by changing the frequency from a frequency appropriate to trapping, to a frequency appropriate to expulsion.

As explained in detail above, in the present invention, by using latent image carriers having an arithmetic mean surface roughness Ra in the range 0.014 μm through 0.600 μm inclusive, it is possible to obtain excellent transfer efficiency equal to that where virtually all the post-transfer residual toner is opposite polarity toner, and reduce the density unevenness in halftone images.

Various modifications will become possible for those skilled in the art after receiving the teachings of the present disclosure without departing from the scope thereof.

What is claimed is:

1. An image forming apparatus, comprising:

a latent image carrier;

a charging device configured to uniformly charge an endless moving surface of the latent image carrier;

a latent image forming device configured to form a latent image on the surface uniformly charged;

a developing device configured to develop the latent image on the surface to obtain a toner image;

a transfer device configured to transfer the toner image on the surface to a transfer member;

a toner trapping member configured to trap post-transfer residual toner adhering to the surface of the latent image carrier after passing through transfer processing by the transfer device and before entering developing processing by the developing device, the toner trapping member including a brush member having a support member, and a slanting brush member made from a plurality of bristles that are fixed in a slanting attitude to the surface of the support member, the slanting brush member contacting the latent image carrier with an attitude in which a bristles tip side is inclined relative to a bristles root side towards a downstream side in a direction of movement of the surface of the latent image carrier; and an impelling device for impelling the brush member or a rotating brush roller towards the latent image carrier, so that an amount of impelling of the brush member or the rotating brush roller towards the latent image carrier is smaller during a time that the post-transfer residual toner is being trapped by the brush member or the rotating brush roller than during a time that the post-transfer residual toner is being expelled from the brush member or the rotating brush roller to the surface of the latent image carrier, wherein the post-transfer residual toner trapped by the toner trapping member is recovered within the developing device after re-transferring the toner to the surface of the latent image carrier, and the latent image carrier has an arithmetic mean surface roughness Ra equal to or greater than 0.014 μm and equal to or less than 0.60 μm.

2. The image forming apparatus as claimed in claim 1, wherein the number of convex portions on the surface, formed with fine concavity and convexity, of the latent image carrier is equal to or greater than seven per $\mu m^2$ and equal to or less than 15 per $\mu m^2$.

3. The image forming apparatus as claimed in claim 1, wherein the arithmetic mean surface roughness Ra of the latent image carrier is equal to or less than an average particle diameter of the toner multiplied by 0.06.

4. The image forming apparatus as claimed in claim 1, wherein the transfer means is constituted so that after transfer of the toner image on the latent image carrier to an intermediate transfer member, the toner image is transferred to a second intermediate transfer member or onto a recording member.

5. The image forming apparatus as claimed in claim 1, wherein the latent image carrier has a universal hardness within a range 100 $N/mm^2$ through 200$N/mm^2$ obtained in a hardness test in which under an environment of temperature 25° C. and 50% humidity a Vickers square pyramid diamond indenter is pressed into the surface with a maximum force of 6 mN.

6. The image forming apparatus as claimed in claim 1, wherein a coefficient of friction of the surface of the latent image carrier is equal to or less than 0.3.

7. The image forming apparatus as claimed in claim 1, wherein a contact angle with pure water of the surface of the latent image carrier is equal to or greater than 90°.

8. The image forming apparatus as claimed in claim 1, further comprising bias application means for applying a bias that includes at least an alternating current voltage to the brush member, and varying a frequency of the alternating current voltage between during the time that the post-transfer residual toner is trapped by the brush member, and during the time that the post-transfer residual toner is expelled from the brush member to the surface of the latent image carrier.

9. The image forming apparatus as claimed in claim 8, wherein the bias application means is configured such that a change in bias applied to the brush member is performed at least one of immediately after a print job is finished or at a timing between feeding paper during continuous printing.

10. An image forming apparatus, comprising:

a latent image carrier;

a charging device configured to uniformly charge an endless moving surface of the latent image carrier;

a latent image forming device configured to form a latent image on the surface uniformly charged;

a developing device configured to develop the latent image on the surface to obtain a toner image;

a transfer device configured to transfer the toner image on the surface to a transfer member;

a toner trapping member configured to trap post-transfer residual toner adhering to the surface of the latent image carrier after passing through transfer processing by the transfer device and before entering developing processing by the developing device, the toner trapping member including a rotating brush roller having a rotating shaft member that is capable of rotating, the rotating brush roller serving as a charging member for uniformly charging the surface of the latent image carrier while contacting the surface, and a brush roller member made from a plurality of bristles fitted to the peripheral surface of the rotating shaft member, which is a support member; and means for varying the slanting state of the bristles of the rotating brush member in contact with the latent image carrier, the means for varying the slanting state being used as drive means for rotationally driving the rotating brush roller, so that when the post-transfer residual toner is expelled from the rotating brush roller to the surface of the latent image carrier the rotation speed of the rotating brush roller is varied, wherein the post-transfer residual toner trapped by the toner trapping member is recovered within the developing device after re-transferring the toner to the surface of the latent image carrier, and the latent image carrier has an arithmetic mean surface roughness Ra equal to or greater than 0.014 μm and equal to or less than 0.60 μm.

11. The image forming apparatus as claimed in claim 10, further comprising impelling means for impelling the brush member or the rotating brush roller towards the latent image carrier, so that an amount of impelling of the brush member or the rotating brush roller towards the latent image carrier is smaller during a time that the post-transfer residual toner is trapped by the brush member or the rotating brush roller than during a time that the post-transfer residual toner is expelled from the brush member or the rotating brush roller to the surface of the latent image carrier.

12. The image forming apparatus as claimed in claim 10, wherein the number of convex portions on the surface, formed with fine concavity and convexity, of the latent image carrier is equal to or greater than seven per $\mu m^2$ and equal to or less than 15 per $\mu m^2$.

13. The image forming apparatus as claimed in claim 10, wherein the arithmetic mean surface roughness Ra of the latent image carrier is equal to or less than an average particle diameter of the toner multiplied by 0.06.

14. The image forming apparatus as claimed in claim 10, wherein the transfer means is constituted so that after transfer of the toner image on the latent image carrier to an intermediate transfer member, the toner image is transferred to a second intermediate transfer member or onto a recording member.

15. An image forming apparatus, comprising:

a latent image carrier;

a charging device configured to uniformly charge an endless moving surface of the latent image carrier;

a latent image forming device configured to form a latent image on the surface uniformly charged;

a developing device configured to develop the latent image on the surface to obtain a toner image;

a transfer device configured to transfer the toner image on the surface to a transfer member;

a toner trapping member configured to trap post-transfer residual toner adhering to the surface of the latent image carrier after passing through transfer processing by the transfer device and before entering developing processing by the developing device, the toner trapping member including a rotating brush roller having a rotating shaft member that is capable of rotating, the rotating brush roller serving as a charging member for uniformly charging the surface of the latent image carrier while contacting the surface, and a brush roller member made from a plurality of bristles fitted to the peripheral surface of the rotating shaft member, which is a support member; and bias application means for applying a bias that includes at least an alternating current voltage to the rotating brush roller, and varying a frequency of the alternating current voltage between during the time that the post-transfer residual toner is trapped by the rotating brush roller, and during the time that the post-transfer residual toner is expelled from the rotating brush roller to the surface of the latent image carrier, wherein the post-transfer residual toner trapped by the toner trapping member is recovered within the developing device after re-transferring the toner to the surface of the latent image carrier, and the latent image carrier has an arithmetic mean surface roughness Ra equal to or greater than 0.014 μm and equal to or less than 0.60 μm.

16. The image forming apparatus as claimed in claim 15, wherein the bias application means is configured such that a change in bias applied to the brush roller member is performed at least one of immediately after a print job is finished or at a timing between feeding paper during continuous printing.

17. The image forming apparatus as claimed in claim 15, wherein the number of convex portions on the surface, formed with fine concavity and convexity, of the latent image carrier is equal to or greater than seven per $\mu m^2$ and equal to or less than 15 per $\mu m^2$.

18. The image forming apparatus as claimed in claim 15, wherein the arithmetic mean surface roughness Ra of the latent image carrier is equal to or less than an average particle diameter of the toner multiplied by 0.06.

19. The image forming apparatus as claimed in claim 15, wherein the transfer means is constituted so that after transfer of the toner image on the latent image carrier to an intermediate transfer member, the toner image is transferred to a second intermediate transfer member or onto a recording member.

* * * * *